United States Patent [19]

Dwyer et al.

[11] 4,441,991

[45] Apr. 10, 1984

[54] CATALYTIC DEWAXING OF OILS CONTAINING AMMONIA OVER HIGHLY SILICEOUS POROUS CRYSTALLINE MATERIALS OF THE ZEOLITE ZSM-5 TYPE

[75] Inventors: Francis G. Dwyer, West Chester, Pa.; William E. Garwood, Haddonfield, N.J.

[73] Assignee: Mobil Oil Corporation, New York, N.Y.

[21] Appl. No.: 435,424

[22] Filed: Oct. 20, 1982

Related U.S. Application Data

[63] Continuation-in-part of Ser. No. 256,213, Apr. 21, 1981, abandoned.

[51] Int. Cl.[3] ..... C10G 47/16

[52] U.S. Cl. ..... 208/111; 208/18; 208/28; 208/57; 208/89

[58] Field of Search ..... 208/111

[56] References Cited

U.S. PATENT DOCUMENTS

| | | | |
|---|---|---|---|
| Re. 28,398 | 4/1975 | Chen et al. | 208/111 |
| Re. 29,948 | 3/1979 | Dwyer et al. | 208/110 |
| 3,941,871 | 3/1976 | Dwyer et al. | 423/326 |
| 4,061,724 | 12/1977 | Grose et al. | 423/335 |
| 4,073,865 | 2/1978 | Flanigen et al. | 423/335 X |
| 4,247,388 | 1/1981 | Banta et al. | 208/111 |
| 4,257,872 | 3/1981 | LaPierre et al. | 208/59 |
| 4,263,129 | 4/1981 | Chen et al. | 208/111 |
| 4,269,697 | 5/1981 | Chen et al. | 208/120 |
| 4,282,085 | 8/1981 | O'Rear et al. | 208/120 |
| 4,284,529 | 8/1981 | Shihabi | 252/455 |
| 4,309,275 | 1/1982 | Mulaskey | 208/109 |
| 4,309,276 | 1/1982 | Miller | 208/109 |
| 4,313,817 | 2/1982 | Mayer et al. | 208/89 |
| 4,315,814 | 2/1982 | Shihabi | 208/111 |

*Primary Examiner*—Delbert E. Gantz
*Assistant Examiner*—George Schmitkons
*Attorney, Agent, or Firm*—Alexander J. McKillop; Michael G. Gilman; Stanislaus Aksman

[57] ABSTRACT

Straight-chain hydrocarbons and slightly branched chain hydrocarbons are selectively converted utilizing highly siliceous porous crystalline materials of the zeolite type having $SiO_2/Al_2O_3$ ratio of greater than 200, unique molecular sieving properties and superior resistance to ammonia deactivation. The catalyst preferably contains acidic cations and can also contain a component having a hydrogenation/dehydrogenation function. The process of this invention is particularly useful for the dewaxing of hydrocarbon oils, including removal of high freezing point paraffins from jet fuel to lower freezing point, as well as improving the octane rating of naphtha fractions.

19 Claims, 3 Drawing Figures

CATALYTIC DEWAXING OF OILS CONTAINING AMMONIA OVER HIGHLY SILICEOUS POROUS CRYSTALLINE MATERIALS OF THE ZEOLITE ZSM-5 TYPE

CROSS-REFERENCE TO RELATED APPLICATIONS

This application is a continuation-in-part of a copending U.S. application Ser. No. 256,213, filed Apr. 21, 1981, (and now abandoned) the entire content of which is incorporated herein by reference.

BACKGROUND OF THE INVENTION

1. Field of the Invention

This invention relates to novel improved dewaxing processes carried out in the presence of highly siliceous porous crystalline materials.

2. Description of the Related Art

It is known to treat gas oil fractions, i.e. petroleum fractions having an initial boiling point of at least about 330° F., so as to selectively remove paraffinic hydrocarbons therefrom. This technique is desirable in order to permit many of these fractions to meet a pour point standard. In particular, many light gas oil fractions, that is, those which are used for No. 2 fuel (home heating oil) and/or Diesel fuel, have pour points which are too high to permit their intended use. A typical pour point specification is 0° F., whereas it is not uncommon for such gas oil fractions to have untreated pour points of 50° F. or higher.

Patents have issued on improved hydrodewaxing processes and catalysts, including U.S. Pat. No. 3,700,585 which discloses and claims such process using a ZSM-5 type zeolite catalyst.

Prior to the discovery in U.S. Pat. No. 3,700,585, reissued as Re. 28,398, the entire contents of both of which are incorporated herein by reference, a wide variety of zeolitic materials and particularly crystalline aluminosilicates had been successfully employed in various catalytic conversion processes. However, these prior art processes, in general, fell into one of two main categories. In one type of conversion process, a zeolite was employed which had a pore size sufficiently large to admit the vast majority of components normally found in a charge. These zeolites are called large pore size molecular sieves, and they generally have a pore size of from 6 to 13 Angstroms and are represented by zeolites X, Y and L. The other type of aluminosilicate was one which had a pore size of approximately 5 Angstrom units and it was utilized to preferentially act upon normal paraffins to the substantial exclusion of other molecular species. Thus, by way of oversimplification, up until that invention, there were only two types of aluminosilicates which were available for hydrocarbon processing—those which would admit only normal paraffins and those which would admit all components normally present in a hydrocarbon feed charge.

In the reissue patent U.S. Pat. No. Re. 28,398, there was disclosed and claimed, among other things, catalytic dewaxing of oils over zeolites having the characteristics X-ray diffraction pattern of zeolite ZSM-5 and the compositions:

$$(0.9\pm0.2)M_{2/n}O:Al_2O_3:(5-100)SiO_2:zH_2O$$

wherein M was a cation, n the valence thereof, and z was from 0 to 40. These compositions had $SiO_2/Al_2O_3$ (silica/alumina) mole ratios of 5:1 to 100:1.

SUMMARY OF THE INVENTION

In accordance with the present invention, catalytic dewaxing and hydrodewaxing of hydrocarbon feedstocks, e.g., gas oils, has been found to be conductible over highly siliceous porous crystalline materials related to the zeolite ZSM-5 and having $SiO_2/Al_2O_3$ mole ratios greater than 200:1 up to infinity, which materials have been found to have superior resistance to ammonia deactivation in said catalytic dewaxing and hydrodewaxing of gas oils.

The highly siliceous porous crystalline materials employed in the present invention are disclosed and claimed in prior art, e.g., in U.S. Pat. No. 3,941,871, reissued as U.S. Pat. No. Re. 29,948 (the entire contents of both of which are incorporated herein by reference), and described in greater detail hereinbelow.

DESCRIPTION OF PREFERRED EMBODIMENTS

Figure 1:
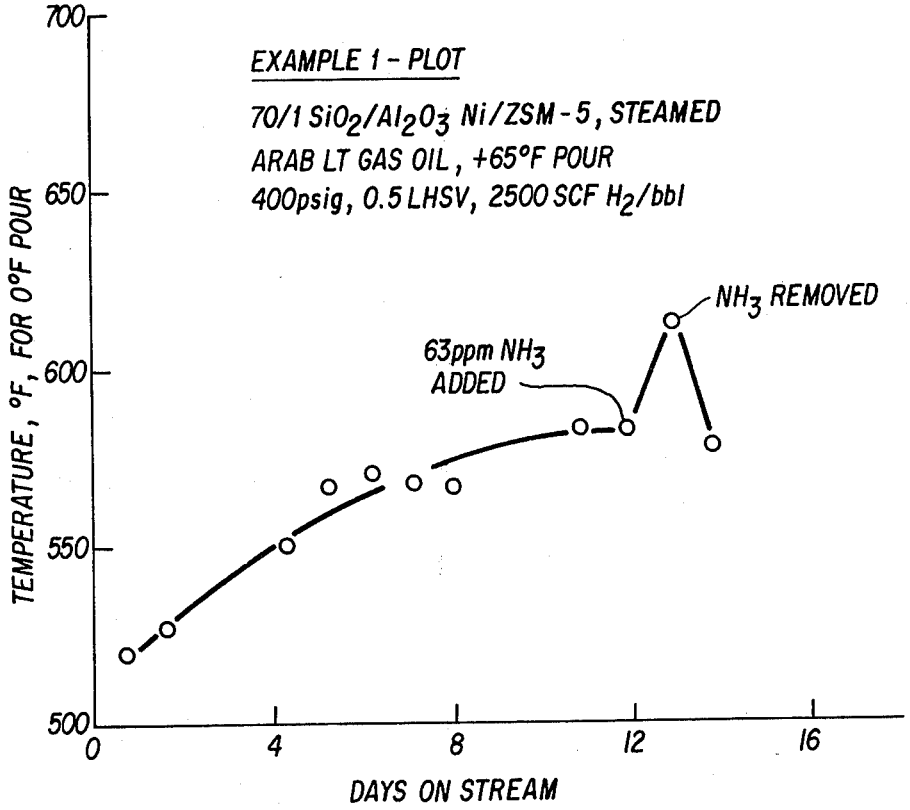
FIG. 1 is a plot of the temperature used in the dewaxing process necessary to obtain a product having a pour point of 0° F. as a function of days the catalyst has been used, for the data of Example 1.

In accord with U.S. Pat. No. Re. 28,398, it was discovered that very effective catalytic operations could be carried out by utilizing a class of zeolitic molecular sieves which possessed unique sieving properties in that they allowed entry and egress to their internal pore structure of not only normal paraffins but also of slightly branched paraffins, and yet had the ability to exclude heavily branched isoparaffins. Thus, it was possible to carry out hydrocarbon conversion processes which were not only selective towards normal paraffins, but also were selective towards slightly branched paraffins and, in particular, monomethyl-substituted paraffins. It was discovered that when zeolitic materials exhibiting these properties were employed in those dewaxing operations where it had been heretofore desirous only to selectively remove normal paraffins, many increased and unexpected benefits would occur in that the resulting products had enhanced economic value.

As has heretofore been stated, all the crystalline aluminosilicate materials heretofore employed in prior art processes fell into one of two general types. They either had pore sizes of about 5 Angstrom units or they had pore sizes from about 6 to about 15 Angstrom units. The 5 Angstrom unit aluminosilicates were generally stated to be shape selective in that they allowed selective conversion of normal aliphatic compounds from a mixture of the same with isoaliphatic compounds and cyclic compounds. The second type of aluminosilicates, i.e., those having a pore size of 6 to 15 Angstrom units, was generally stated to be nonselective, i.e., substantially all of the molecules normally found in a hydrocarbon feed stream were able to enter into the internal pore structure of the zeolites and be converted. Thus, heretofore a very convenient method of identifying a good shape selective catalyst was to show that it would selectively crack normal hexane from a mixture of the same with 2-methyl pentane, since the former was able to enter its internal pore structure, whereas the latter isocompound was unable to do so.

In accordance with the present invention, it has now been discovered that a crystalline material previously disclosed, e.g., in U.S. Pat. No. Re. 29,948, and having a $SiO_2/AL_2O_3$ mole ratio greater than 200, when used in the dewaxing or hydrodewaxing process of U.S. Pat. No. Re. 28,398, has an unexpectedly superior resistance to deactivation by ammonia ($NH_3$) present to some degree in refinery streams used in the aforementioned dewaxing or hydrodewaxing processes. Ammonia is present in refinery streams used in the dewaxing or hydrodewaxing processes in varying amounts. In addition, small amounts of ammonia are also made in the process, so that the total amount of ammonia present in the dewaxing reactor may range from 1 to 250 parts per million (ppm), and it usually is 1 to 180 ppm. ZSM-5 type zeolites having $SiO_2/AL_2O_3$ mole ratios of 5:1 to 100:1 lose a substantial portion of their activity upon contact with ammonia. However, the crystalline materials used in the process of the present invention, having $SiO_2/Al_2O_3$ mole ratio of greater than 200, are unusually resistant to deactivation by ammonia. For example, the deactivating effect of ammonia on activity of the crystalline materials having $SiO_2/AL_2O_3$ ratio of 1670/1 is less than half of that occuring on crystalline materials having $SiO_2/AL_2O_3$ ratio of 70/1, when the hydrodewaxing process is operated at 750°–780° F. The dewaxing process of this invention is predicated upon using the above-identified highly siliceous crystalline materials which can generally be stated to be intermediate between the two types of aluminosilicates heretofore employed. Thus, catalysts of this invention will allow the entry into their internal pore structure of normal aliphatic compounds and slightly branched aliphatic compounds, particularly monomethyl-substituted compounds, yet substantially exclude all compounds containing at least a quaternary carbon atom or having a molecular dimension equal to or substantially greater than a quaternary carbon atom. Additionally, aromatic compounds having side chains similar to the normal aliphatic compounds and slightly branched aliphatic compounds above described could have said side chains enter the internal pore structure of the catalysts used in this invention. Thus, if one were to measure the selectivity of the materials employed in the process of this invention by the heretofore mentioned prior art tests, i.e., the ability to selectively crack hexane from a mixture of the same with isohexane, these catalysts would have to be characterized as being non-shape selective. It should be immediately apparent, however, that the term "selectivity" has a far greater significance than merely the ability to preferentially distinguish between normal paraffins and isoparaffins. Selectivity on shape is theoretically possible at any shape or size, although, quite obviously, such selectivity might not result in an advantageous catalyst for any and all hydrocarbon conversion processes.

The novel dewaxing process of this invention is based upon the fact that, although it is art-recognized that in the vast majority of refinery operations it is desirable to preserve aromatics and to remove normal paraffins, nevertheless, such a generalization is not the final word in obtaining maximum yields of economically enhanced products. It has now been discovered that enhanced benefits can be obtained if a catalyst system could be designed which would selectively convert normal paraffins and certain isoparaffins, and yet not affect desirable components in a given feedstock. This type of molecular processing or sieving was heretofore unknown. As has been stated, all the previous catalytic processing involving the use of zeolitic molecular sieves merely gave the operator two choices. He could either use a molecular sieve which was a catalyst of generalized competence, i.e., it would act upon substantially all of the molecules normally found in a hydrocarbon feed, or he could use a catalyst which had a pore size of about 5 Angstrom units, thereby allowing selective conversion of normal aliphatic compounds only.

A test method has been devised in order to determine whether or not a zeolite possesses the unique molecular sieving properties necessary to carry out the novel conversion process of this invention. In said test method, a candidate zeolite free from any matrix or binder is initially converted to the so-called acid or hydrogen form. This procedure involves exhaustive exchange with an ammonium chloride solution in order to replace any metallic cations originally present. The sample is then sized up to 20–30 mesh and calcined in air for 16 hours at 550° C. One gram of the so-treated zeolite is then contacted with benzene at a pressure of 12 torr at a temperature of 25° C. for a time period of 2 hours. Another gram sample is contacted with mesitylene at a pressure of 0.5 torr at a temperature of 25° C. for a period of 6 hours. An operable zeolite is one whose acid form will absorb at least 3.0 weight percent benzene and less than 1.5 weight percent mesitylene at the above recited conditions.

Examples of the highly siliceous porous crystalline materials which are operable in the process of this invention are those of the zeolite ZSM-5 type disclosed and claimed in U.S. Pat. No. Re. 29,948. These highly siliceous materials of the ZSM-5 type are prepared from a reaction mixture containing no added alumina in the recipe. Any alumina present is there only as an impurity in the reactants. These crystalline materials were surprisingly found to be characterized by an X-ray diffraction pattern characteristic of the above-noted ZSM-5 type crystalline materials. In addition to having such characteristic X-ray diffraction pattern, the crystalline materials used in the present invention are identified in their anhydrous state in terms of mole ratios of oxides as follows:

$$0.9\pm0.2[xR_2O+(1-x)M_{2/n}O]:<0.005\ Al_2O_3:>1\ SiO_2$$

wherein M is a metal other than a metal of Group IIIA, n is the valence of said metal, R is an alkyl ammonium radical and x is greater than 0 but not exceeding 1. Preferably R is a tetraalkyl ammonium radical, the alkyl groups of which contain 2–5 carbon atoms.

In the above composition, $R_2O$ and $M_{2/n}O$ may be removed by replacement with or conversion to other desired components which serve to enhance catalytic activity, stability and/or adsorption characteristics. It is particularly contemplated that R and/or M may be at least partially in the ammonium form as a result of ion exchange.

As above noted, the family of highly siliceous porous crystalline materials disclosed and claimed in U.S. Pat. No. Re. 29,948 has a definite X-ray diffraction pattern. Such X-ray diffraction pattern, similar to that for the ZSM-5 zeolites, shows the following significant lines:

TABLE I

| Interplanar Spacing d(A) | Relative Intensity |
|---|---|
| 11.1 ± 0.2 | s |
| 10.0 ± 0.2 | s |
| 7.4 ± 0.15 | w |
| 7.1 ± 0.15 | w |
| 6.3 ± 0.1 | w |
| 6.04 ± 0.1 | w |
| 5.97 | |
| 5.56 ± 0.1 | w |
| 5.01 ± 0.1 | w |
| 4.60 ± 0.08 | w |
| 4.25 ± 0.08 | w |
| 3.85 ± 0.07 | vs |
| 3.71 ± 0.05 | s |
| 3.04 ± 0.03 | w |
| 2.99 ± 0.02 | w |
| 2.94 ± 0.02 | w |

These values were determined by standard techniques. The radiation was the K-alpha doublet of copper and a Geiger Counter Spectrometer with a strip chart pen recorder was used. The peak heights, I, and the positions as a function of two times theta, where theta is the Bragg angle, were read from the spectrometer chart. From these, the relative intensities, 100 $I/I_O$, where $I_O$ is the intensity of the strongest line or peak and d(obs.) the interplanar spacing in A, corresponding to the recorded lines, were calculated. In Table I, the relative intensities are given in terms of the symbols s=strong, w=weak, and vs=very strong.

The crystalline materials of the present invention can be used either in the alkali metal form, e.g., the sodium form, other desired metal form, the ammonium form or the hydrogen form, preferably, in the ammonium or the hydrogen form. They can also be used in intimate combination with a hydrogenation component, such as tungsten, vanadium, molybdenum, rhenium, nickel, cobalt, chromium, manganese or a noble metal, such as platinum or palladium where a hydrogenation-dehydrogenation function is to be performed. Such component can suitably be impregnated on or physically intimately admixed with the crystalline material.

The crystalline materials of this invention, as synthesized or after impregnation, can be beneficially converted to another form by thermal treatment. This can be done by heating to a temperature in the range of 200° C. to 600° C. in an inert gaseous atmosphere of, e.g., air, nitrogen, and at atmospheric or subatmospheric pressures for between 1 and 48 hours. Dehydration may also be performed at lower temperatures merely by placing the crystalline material in a vacuum, but a longer time is required to obtain a sufficient amount of dehydration.

The crystalline materials of the invention can be suitably synthesized by preparing a solution containing $(R_4N)_2O$, sodium oxide, an oxide of a metal other than a metal of Group IIIA and water and having a composition in terms of mole ratios of oxides falling within the following ranges:

TABLE II

| | Broad | Preferred |
|---|---|---|
| $OH^-/SiO_2$ | 0.01-5 | 0.05-1.0 |
| $R_4N^+/(R_4N^+ + Na^+)$ | 0.05-1.0 | 0.1-0.8 |
| $H_2O/OH^-$ | 50-1000 | 50-500 |

TABLE II-continued

| | Broad | Preferred |
|---|---|---|
| $SiO_2/M_{2/n}O$ | 1 | 3 |

wherein R is an alkyl radical, preferably containing between 2 and 5 carbon atoms, and M is total metal. Thereafter, the mixture is maintained until crystals of the crystalline material are formed. Preferably, crystallization is performed under pressure in an autoclave or static bomb reactor. The temperature ranges from 100° C. to 200° C. generally, but at lower temperatures, e.g., about 100° C., crystallization time is longer. Thereafter, the crystals are separated from the liquid and recovered. Typical reaction conditions consist of heating the foregoing reaction mixture to a temperature from about 100° C. to 175° C. for a period of time of from about 6 hours to 60 days. The more preferred temperature range is from about 100° C. to 175° C., with the amount of time at a temperature in such range being from about 12 hours to 30 days.

The treatment of the amorphous mixture is carried out until crystals form. The resulting crystalline product is separated from the reaction medium, e.g., by cooling to room temperature, filtering and water washing. The product so obtained is dried, e.g., at 230° F., for from about 8 to 24 hours. If desired, milder conditions may be employed, e.g., room temperature under vacuum.

The desired crystalline material can be prepared utilizing materials which supply the appropriate oxide. Such materials include, e.g., sodium silicate, colloidal silica, silica hydrosol, silica gel, silicic acid, sodium hydroxide, compounds of the desired metal, other than a metal of Group IIIA, and tetraalkyl ammonium compounds, e.g., tetrapropyl ammonium bromide. In addition to tetrapropyl ammonium compounds, it is contemplated that tetramethyl, tetraethyl or tetrabutyl ammonium compounds may similarly be employed. It will be understood that each oxide component utilized in the reaction mixture for preparing the crystalline materials of this invention can be supplied by one or more initial reactants and they can be mixed together in any order. For example, sodium oxide can be supplied by an aqueous solution of sodium hydroxide or by an aqueous solution of sodium silicate; tetrapropyl ammonium can be supplied in the form of its hydroxide, as can the other tetraalkyl ammonium radicals noted hereinabove. The reaction mixture can be prepared either batchwise or continuously. Crystal size and crystallization time of the crystalline metal organosilicate composition will vary with the nature of the reaction mixture employed.

The crystalline materials described herein are substantially free of alumina, but may contain very minor amounts of such oxide attributable primarily to the presence of aluminum impurities in the reactants and/or equipment employed. Thus, the molar ratio of silica to alumina is in the range of greater than 200:1 to infinity. Generally, the molar ratio of silica to alumina is in the range of greater than 200 to 100,000.

The crystalline materials as synthesized can have the original components thereof replaced by a wide variety of other components according to techniques well known in the art. Typical replacing components include hydrogen, ammonium, alkyl ammonium and aryl ammonium and metals, other than metals of Group IIIA, including mixtures of the same. The hydrogen form may be prepared, for example, by substitution of original sodium with ammonium. The composition is then calcined at a temperature of, e.g., 1000° F., causing evolution of ammonia and retention of hydrogen in the composition. Of the replacing metals, preference is accorded to metals of Groups II, IV and VIII of the Periodic Table.

The crystalline materials are then preferably washed with water and dried at a temperature ranging from 150° F. to about 600° F. and thereafter calcined in air or other inert gas at temperatures ranging from 500° F. to 1500° F. for periods of time ranging from 1 to 48 hours or more.

In catalytic applications, such as the dewaxing or hydrodewaxing process of this invention, it is preferred to reduce the sodium or other alkali metal content of the as-synthesized zeolite to a level of at least less than 50 percent of the amount of the metal originally contained in the zeolite, so that the sodium, or other alkali metal, content in the catalytic form of the zeolite is normally less then about 0.5 percent by weight, usually less than about 0.1 percent by weight, preferably less than about 0.03 percent by weight, and most preferably less than about 0.01 percent by weight. The as-synthesized zeolite may be conveniently converted into the hydrogen, the univalent or multivalent cationic forms by base exchanging the zeolite to remove the sodium, or other alkali metal, cations by such ions as hydrogen (from acids), ammonium, alkylammonium and arylammonium, including $RNH_3$, $R_3NH^+$, $R_2NH_2^+$ and $R_4N^+$, where R is alkyl or aryl, provided that steric hindrance does not prevent the cations from entering the cage and cavity structure of the high silica/alumina ratio zeolite catalyst used herein. The hydrogen form of the zeolite is prepared, for example, by base exchanging the sodium form with a source of hydrogen cation, e.g., ammonium chloride or hydroxide, whereby the ammonium ion is substituted for the sodium ion. The composition is then calcined at a suitable temperature, e.g., 1000° F. (about 540° C.), causing the evolution of ammonia and the retention of the hydrogen proton in the composition. Other replacing cations include cations of the metals of the Periodic Table, particularly metals other than sodium, most preferably metals of Group IIA, e.g., zinc, and of Groups IB, IIIA, IIIB, IVA, IVB, VIB and VIII of the Periodic Table, and rare earth metals and manganese.

Ion exchange of the zeolite can be accomplished conventionally, e.g., by admixing the zeolite with a solution of a cation to be introduced into the zeolite. Ion exchange with various metallic and non-metallic cations can be carried out according to the procedures described in U.S. Pat. Nos. 3,140,251, 3,140,252 and 3,140,253, the entire contents of all of which are incorporated herein by reference.

Regardless of the synthesized form of the crystalline material, the spatial arrangement of atoms which form the basic crystal lattices remains essentially unchanged by the described replacement of sodium or other alkali metal or by the presence in the initial reaction mixture of metals in addition to sodium, as determined by an X-ray powder diffraction pattern of the resulting crystalline material. The X-ray diffraction patterns of such products are essentially the same as those set forth in Table I above.

The crystalline materials prepared in accordance with the procedure of U.S. Pat. No. Re. 29,948 are formed in a wide variety of particle sizes. Generally, the particles can be in the form of powder, a granule, or a molded product, such as an extrudate having a particle size sufficient to pass through a 2 mesh (Tyler) screen and be maintained on a 400 mesh (Tyler) screen in cases where the catalyst is molded, such as by extrusion. The crystalline material can be extruded before drying, or dried or partially dried and then extruded.

In the case of many catalysts, it is desired to incorporate the crystalline material used in this process with another material resistant to the temperatures and other conditions employed in organic processes. Such materials include active and inactive materials and synthetic and naturally occurring zeolites as well as inorganic materials, such as clays, silica and/or metal oxides. The latter may be either naturally occurring or in the form of gelatinous precipitates or gels including mixtures of silica and metal oxides. Use of the other materials in conjunction with the active crystalline materials used in the dewaxing process, i.e., combined therewith, tends to improve the conversion and/or selectivity of the catalyst in certain organic conversion processes. Inactive materials suitably serve as diluents to control the amount of conversion in a given process so that products can be obtained economically and in an orderly manner without employing other means for controlling the rate of reaction. Normally, crystalline materials have been incorporated into naturally occurring clays, e.g., bentonite and kaolin, to improve the crush strength of the catalyst under commercial operating conditions. These materials, i.e., clays, oxides, etc., function as binders for the catalyst. It is desirable to provide a catalyst having good crush strength because in a petroleum refinery the catalyst is often subjected to rough handling which tends to break the catalyst down into powder-like materials which cause problems in processing. These clay binders have been employed for the purpose of improving the crush strength of the catalyst.

Naturally occurring clays that can be composited with the crystalline materials used herein include the montmorillonite and kaolin family, which families include the subbentonites and the kaolins known commonly as Dixie, McNamee-Georgia and Florida or others in which the main constituent is halloysite, kaolinite, dickite, nacrite or anauxite. Such clays can be used in the raw state as originally mined or initially subjected to calcination, acid treatment or chemical modification.

In addition to the foregoing materials, the crystalline materials used in this invention may be composited with a porous matrix material such as silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. The matrix can be in the form of a cogel, and the matrix itself may be free of hydrocracking or cracking activity or it may have some cracking or hydrocracking activity of its own. The relative proportions of finally divided crystalline material and inorganic oxide gel matrix can vary widely, with the crystalline material content ranging from about 1 to 90 percent by weight and more usually in the range of about 2 to about 50 percent by weight of the composite. The composite itself may be substantially free of hydrogenation activity or it may have some hydrogenation activity.

In some cases, activity of some high-silica containing zeolites may be enhanced by combining the zeolite with a solid binder, such as alumina, in the presence of water (see, e.g., a copending U.S. patent application of Garwood, et al., Ser. No. 391,212, filed June 23, 1982).

As has heretofore been pointed out, the novel process of this invention is concerned with dewaxing of hydrocarbon feedstocks. The term "dewaxing", as used in the specification and claims, is used in its broadest sense and is intended to mean the removal of those hydrocarbons which readily solidify (waxes) from petroleum stocks. Hydrocarbon feeds which can be treated in the present process are any feedstocks which are liquid at ambient conditions and which contain at least some readily solidifieable components. Examples of suitable feedstocks are: naphtha, reformate, kerosene, diesel fuel, heating fuel, jet fuel, gas oil and lube oil stocks. Such hydrocarbon stocks contain material having a boiling point of above about 350° F. and they usually contain at least some normal and slightly branched paraffins, i.e., at least 3 weight percent, preferably at least 5 weight percent and most preferably about 10 to about 40 weight percent of normal and slightly branched paraffins.

The dewaxing can be carried out at either cracking or hydrocracking conditions in accordance with the process conditions set forth in U.S. Pat. No. Re. 28,398. As is known in the art, the product stream of the dewaxing process of that patent, conducted at either cracking or hydrocracking conditions, in addition to having reduced pour point vis-a-vis the feedstock pour point, also has a greater olefin content than the feedstock (see, e.g., U.S. Pat. No. 3,852,189 to Chen et al., and to O'Rear et al., U.S. Pat. No. 4,282,085, and Chen et al., *New Process Cuts Pour Point of Distillates,* Oil and Gas Journal, June 6, 1977). The olefin content of the product of such process is at least 5 percent by weight. Typical olefins produced in the process are propylene, butenes and pentenes. As is also known in the art, the product of the process has a higher octane rating than the feedstock.

The catalyst used in the process of this invention is a highly siliceous porous crystalline material related to the zeolite ZSM-5, having a $SiO_2/Al_2O_3$ mole ratio greater than about 200 and having an X-ray diffraction pattern set forth in Table I. Examples of suitable catalysts are zeolites disclosed in U.S. Pat. No. Re. 29,948 of Dwyer et al., and equivalents of such zeolites, e.g., silicalite disclosed in U.S. Pat. No. 4,061,724 of Grose et al. The equivalency of these two zeolites is known in the art, as discussed, for example, by Fyfe et al., in *Resolving Crystallographically Distinct Tetrahedral Sites in Silicalite and ZSM-5 by Solid State NMR,* 296 Nature 530 Apr. 8, 1982), by Rees in *When is a Zeolite Not a Zeolite,* 296 Nature 491 (Apr. 8, 1982), and by Dibby et al., in *Silicalite*-2, a Silica Analogue of the Aluminosilicate Zeolite ZSM-11, 280 Nature (Aug. 23, 1979).

Employing the catalyst used in the process of this invention, containing a hydrogenation component, heavy petroleum residual stocks, cycle stocks, and other hydrocrackable charge stocks can be hydrocracked at temperatures between about 400° F. and about 825° F., using molar ratios of hydrogen to hydrocarbon charge in the range between about 2 and about 80. The pressure employed will vary between about 10 and about 2500 psig, and the liquid hourly space velocity between about 0.1 and about 10.

Employing the catalyst used in the process of this invention for catalytic cracking, hydrocarbon cracking stocks can be cracked at a liquid hourly space velocity between about 0.5 and about 50, a temperature between about 550° F. and about 1100° F., a pressure between about subatmospheric and several hundred atmospheres.

In order to more fully illustrate the nature of the invention and a manner of practicing the same, the following examples are presented.

CATALYST SYNTHESIS

EXAMPLE A

70/1 $SiO_2/AL_2O_3$ ZSM-5 Catalyst Preparation

A sodium silicate solution was prepared by mixing 16 parts water and 27.7 parts sodium silicate (28.7 weight percent $SiO_2$, 8.9 weight percent $Na_2O$, 62.4 percent $H_2O$) followed by addition of 0.08 parts Daxad 27, (trademark of W. R. Grace and Co., Chemical Division). The solution was cooled to approximately 15° C.

An acid solution was prepared by adding 1 part aluminum sulfate (17.2 weight percent $AL_2O_3$) to 16.4 parts water followed by 2.4 parts sulfuric acid (93 weight percent $H_2SO_4$) and 1.2 parts NaCl.

These solutions were mixed in an agitated vessel while 3.9 parts of NaCl were added. The gel molar ratios expressed as oxides are as follows:

$$SiO_2/AL_2O_3=78.4$$

$$Na_2O/AL_2O_3=49.9$$

An organic solution was prepared by adding 1.6 parts n-propyl bromide and 3.1 parts methylethyl ketone to 1.9 parts tri-n-propylamine.

After the gel was heated to about 95° C., agitation was reduced and the organic solution was added above the gel. This mixture was held at about 95°–110° C. for 14 hours, then severe agitation was resumed. When approximately 65 percent of the gel was crystallized, the temperature was increased to 150°–160° C. and held at that level until crystallization was completed. Unreacted organics were removed by flashing and the remaining contents cooled.

The zeolite slurry product was diluted with 4–5 parts water per part slurry and 0.0002 parts of flocculent (Rohm and Haas Primafloc C-7) per part slurry, allowed to settle and supernatant liquid was drawn off. The settled solids were reslurried to the original volume of the preceding step with water and 0.00005 parts of flocculent per part slurry. After settling, the aqueous phase was decanted. This procedure was repeated until the sodium level of the zeolite was less than 1.0 weight percent. The washed zeolite was then filtered, dried and identified as ZSM-5 having a silica/alumina mole ratio of about 70, and a constraint index of about 8.3

The dried zeolite was then mixed with alumina and water. It was then extruded into 1/16" pellets and dried. The extruded material contained 65 parts ZSM-5 per 35 parts alumina.

The dried extrudate was calcined for three hours at 538° C. in flowing nitrogen. After cooling, the extrudate was contacted with an ammonium nitrate exchange solution (about 0.08 lb $NH_4NO_3$/lb extrudate) for one hour at ambient temperature. This exchange was then repeated until the sodium level was less than 0.05 weight percent. The extrudate was then contacted with a nickel nitrate exchange solution [about 0.1 lb $Ni(NO_3)_2.6H_2O$/lb extrudate] for two hours at about 80°–90° C. After this exchange, the extrudate was washed, dried and calcined in a flowing gas mixture (approximately 10 percent air-90 percent nitrogen) at 538° C. for six hours.

EXAMPLE B

1670/1 $SiO_2/AL_2O_3$ ZSM-5 Catalyst Preparation

I. Prereacted organics preparation

The following materials were charged to an autoclave: 0.30 parts methylethyl ketone, 0.18 parts tri-n-propylamine and 0.15 parts n-propyl bromide. The contents were mixed with gentle agitation for 15 minutes. The agitation was stopped and 1 part water was charged to the autoclave. The autoclave was sealed and heated to 220° F. and held at 220° F. for 15 hours. After this reaction period the temperature was raised to 320° F. and the unreacted organics were flashed off. The aqueous phase was removed containing the prereacted organics and it contained 1.44 percent by weight nitrogen.

II. 1670/1 $SiO_2/Al_2O_3$ Catalyst Synthesis (a) Solution Preparation

| | |
|---|---|
| | Silicate Solution |
| 1 part | Q-brand sodium silicate |
| 0.58 parts | $H_2O$ |
| 0.0029 parts | Daxad 27 |
| | Acid Solution |
| 0.10 parts | $H_2SO_4$ |
| 0.045 parts | NaCl |
| 0.56 parts | prereacted organics (same as in Example B.I., above) |
| 0.16 parts | $H_2O$ |
| | Additional Solids |
| 0.14 parts | NaCl |
| | Additional Liquid |
| 0.029 parts | $H_2O$ |

(b) Procedure

The silicate solution and the acid solution were mixed in a mixing nozzle to form a gel which was discharged into an autoclave to which 0.029 parts water had been previously added. The gel was whipped by agitation, and 0.14 parts of NaCl were added and thoroughly blended. The autoclave was sealed and heated to about 220° F. with agitation at 90 rpm and held for 54 hours until crystallization was completed. Then the temperature was increased to 320° F. to flash residual organics and the contents of the autoclave were cooled and discharged. About 228 lbs. of the product from the autoclave was put into a 55 gallon drum. 1,044 gr. of 2 percent Primafloc C-7 solution (Primafloc C-7 is a high molecular weight cationic flocculent manufactured by Rohm and Haas) was added to about 20 gallons of water in a separate container, and the thus-formed solution was then pumped into the 55 gallon drum containing the product. The remaining volume of the 55 gallon drum was filled water, and the solution was allowed to settle. The residue at the bottom was decanted, 100 gr. of 2 percent Primafloc C-7 was added to 20 gallons of water, and this solution was then pumped into the 55 gallon drum. The remainder of the volume of the 55 gallon was filled with water and again allowed to settle. Then the decantation steps were repeated until the amount of chlorine (Cl) was less than 100 parts per million (ppm). The preparation was then filtered on a Buchner funnel and a sample thereof was submitted for sodium and ash analysis. The percent of sodium in the preparation was 1.6 percent by weight, and that of ash 85.7 percent by weight. The crystallized product was analyzed by X-ray diffraction and was found to be 100 percent by weight ZSM-5. The chemical analysis of the thoroughly washed crystalline product is summarized below:

| | Percent Weight | Mole Ratio |
|---|---|---|
| $Al_2O_3$ | 0.10 | 1.0 |
| $SiO_2$ | 98.3 | 1670 |
| Na | 1.6 | — |
| $Na_2O$ | — | 35.5 |
| N | 0.75 | 63.9 |
| C | 8.98 | 892 |

The silica/alumina ratio of the zeolite was about 1670.

The dried zeolite was then mixed with alumina and water. It was then extruded into 1/16" pellets and dried. The extruded material contained 65 parts ZSM-5 per 35 parts alumina.

The dried extrudate was calcined for three hours at 538° C. in flowing nitrogen. After cooling, the extrudate was contacted with an ammonium nitrate exchange solution [about 0.08 lb $NH_4NO_3$/lb extrudate] for one hour at ambient temperature. This exchange was then repeated until the sodium level was 0.05 weight percent or less. The extrudate was then contacted with a nickel nitrate exchange solution (about 0.1 lb $Ni(NO_3)_2.6H_2O$/lb extrudate) for two hours at about 80°-90° C. This exchange was repeated at room temperature. After this exchange, the extrudate was washed, dried and calcined in flowing air at 538° C. for 3 hours.

DEWAXING PROCESS

EXAMPLE 1

70/1 $SiO_2/Al_2O_3$ ratio Ni/ZSM-5 extrudate, steamed for 6 hours at 850° F. with 100 percent steam, then sulfided in situ, was used in this example. The charge stock was Arab Light Gas Oil, having the following properties:

| | |
|---|---|
| Gravity, °API | 26.3 |
| Gravity, Specific | 0.8967 |
| Pour Point, °F. | +65 |
| Distillation, °F. | |
| IBP | 604 |
| 5 percent | 685 |
| 10 percent | 692 |
| 30 percent | 706 |
| 50 percent | 721 |
| 70 percent | 738 |
| 90 percent | 762 |
| 95 percent | 770 |
| Sulfur, weight percent | 2.33 |
| Nitrogen, ppm | 350 |

The Arab Gas Light Oil had the following approximate composition:

| Component | Wt. % |
|---|---|
| Silica Gel Non-Aromatics | 54.01 |
| Silica Gel Aromatics | 45.99 |
| Total Paraffins | 28.76 |
| Total Naphthenes | 25.25 |
| Total Aromatics | 46.10 |
| Silica Gel Non-Aromatics Composition | |
| Paraffins | 53.17 |
| 1 Ring Naphthenes | 20.93 |

-continued

| Component | Wt. % |
|---|---|
| 2 Ring Naphthenes | 13.45 |
| 3 Ring Naphthenes | 5.85 |
| 4 Ring Naphthenes | 4.41 |
| 5 Ring Naphthenes | 1.20 |
| 6 Ring Naphthenes | 0.85 |
| Mono- Aromatics | 0.15 |
| Silica Gel Aromatics Composition | |
| Alkyl Benzenes | 8.57 |
| Naphthene Benzenes | 5.07 |
| Dinaphthene Benzenes | 4.48 |
| Naphthalenes | 2.03 |
| Acenaphthenes | 3.97 |
| Fluorenes | 4.23 |
| Phenathrenes | 3.21 |
| Naphthene Phenathrenes | 1.91 |
| Pyrenes | 2.42 |
| Chrysenes | 0.59 |
| Benzofluoranthenes | 0.17 |
| Perylenes | 0.06 |
| Dibenzanthracenes | 0.03 |
| Benzothiophenes | 3.24 |
| Dibenzothiophenes | 5.52 |
| Naphthobenzothiophenes | 0.33 |
| Unidentified | 0.27 |

Reaction conditions were 400 psig, 0.5 LHSV and 2500 SCF $H_2$/bbl, with temperature adjusted to get 0° F. pour point. Run data are in Table III (Example 1—run data) and the temperature for 0° F. pour point vs. days on stream in FIG. 1. After about 12 days on stream, the temperature equilibrated at 580° F. At that point, 63 ppm $NH_3$ was dissolved in the charge stock, and that blend charged for 24 hours. Activity loss was 30° F. After an overnight hydrogen purge, the original stock containing no $NH_3$ was recharged, and activity was completely recovered.

TABLE III

EXAMPLE 1 - RUN DATA

Catalyst 70/1 $SiO_2/Al_2O_3$ Ni/ZSM-5, 1.1 wt. percent Ni, steamed 6 hrs 850° F., 100 percent steam, sulfided
Charge Arab Light Gas Oil (+65° F. Pour)
Conditions 0.5 LHSV, 400 psig, 2500 SCF $H_2$/bbl

| Run No. | 1 | 2 | 3 | 4 | 5 | 6 | 7 | 8 | 9 | 10 | 11[1] |
|---|---|---|---|---|---|---|---|---|---|---|---|
| $NH_3$ added | ← | ← | ← | ← | NO | → | → | → | → | 63 ppm | NO |
| Run time, hours | 16.5 | 21.5 | 65 | 22 | 23 | 22.5 | 22.5 | 68 | 26 | 24 | 18 |
| Accumulative time, days | 0.7 | 1.6 | 4.3 | 5.2 | 6.2 | 7.1 | 8.0 | 10.8 | 11.9 | 12.9 | 13.8 |
| Average catalyst temperature, °F. | 555 | 570 | 553 | 552 | 552 | 579 | 579 | 579 | 589 | 590 | 592 |
| Liquid product pour point, °F. | −70 | −85 | +5 | +30 | +35 | −25 | −25 | +5 | −15 | +45 | −30 |
| Material balance, weight percent | — | — | — | 96.8 | 97.6 | 94.6 | 94.6 | 99.4 | 96.8 | 97.5 | 94.2 |
| Yields, weight percent (NLB) | | | | | | | | | | | |
| $C_1 + C_2$ | — | — | — | 0.1 | 0.1 | <0.1 | 0.1 | <0.1 | <0.1 | <0.1 | <0.1 |
| $C_3$, Total | — | — | — | 1.9 | 1.5 | 2.1 | 1.7 | 1.3 | 2.4 | <0.1 | 1.2 |
| $C_3^=$ (propene) as percentage of total $C_3$ | | | | 3 | 3 | 6 | 4 | N/A[3] | 9 | N/A[3] | 11.0 |
| $C_4$, Total | — | — | — | — | — | 1.9 | 1.7 | 2.1 | 1.7 | 3.5 | 2.7 |
| $C_4^=$ (butenes) as percentage of total $C_4$ | | | | 9 | 9 | 11 | 12 | 27 | 19 | 27 | 29 |
| $C_5$, Total | — | — | — | 1.4 | 1.5 | 2.1 | 2.1 | 2.9 | 2.2 | 0.6 | 2.0 |
| $C_5^=$ (pentenes) as percentage of total $C_5$ | | | | 28 | 31 | 18 | 25 | 41 | 36 | 46 | 49 |
| $C_6$ - 330° F. | — | — | — | 94.5 | 95.0 | 93.6 | 94.2 | 92.2 | 6.3 | 1.4 | 6.2 |
| 330° F.+ | — | — | — | | | | | | 86.1 | 97.0 | 88.4 |
| $H_2$ consumption, SCF/bbl | — | — | — | −80 | −70 | −50 | −95 | −5 | −35 | −145 | −150 |
| 330° F.+product | | | | | | | | | | | |
| Gravity, °API | — | — | — | — | — | — | — | — | 24.5 | 26.3 | 25.0 |
| Gravity, specific | — | — | — | — | — | — | — | — | 0.9071 | 0.8967 | 0.9042 |
| Pour point, °F. | — | — | — | — | — | — | — | — | −15 | +50 | −25 |
| Temperature for, 0° F. Pour point liquid Product[2] | 520 | 527 | 550 | 567 | 570 | 567 | 567 | 582 | 581 | 612 | 577 |

[1]Hydrogen purge after $NH_3$-containing charge stock removed.
[2]Correction factor 5° F. in temperature for each 10° F. pour point deviation from 0° F.
[3]Data not available.

EXAMPLE 2

Over a fresh portion of the catalyst of Example 1 was passed Shengli Vacuum Gas Oil having the following properties:

| | |
|---|---|
| Gravity, °API | 34.9 |
| Gravity, Specific | 0.8504 |
| Pour Point, °F. | +70 |
| Distillation, °F. | |
| IBP | 467 |
| 5% | 544 |
| 10% | 567 |
| 30% | 604 |
| 50% | 647 |
| 70% | 687 |
| 90% | 752 |
| 95% | 777 |
| Sulfur, Wt % | 0.44 |
| Nitrogen, ppm | 440 |

The Shengli Vacuum Gas Oil had the following composition:

| Component | Wt. % |
|---|---|
| Silica Gel Non-Aromatics | 75.89 |
| Silica Gel Aromatics | 24.11 |
| Total Paraffins | 45.90 |
| Total Naphthenes | 30.01 |
| Total Aromatics | 24.20 |
| Silica Gel Non-Aromatics Composition | |
| Paraffins | 60.49 |
| 1-Ring Naphthenes | 16.71 |
| 2-Ring Naphthenes | 10.50 |
| 3-Ring Naphthenes | 4.98 |
| 4-Ring Naphthenes | 7.19 |
| 5 Ring Naphthenes | 0.10 |
| Mono-Aromatics | 0.61 |

Figure 2:
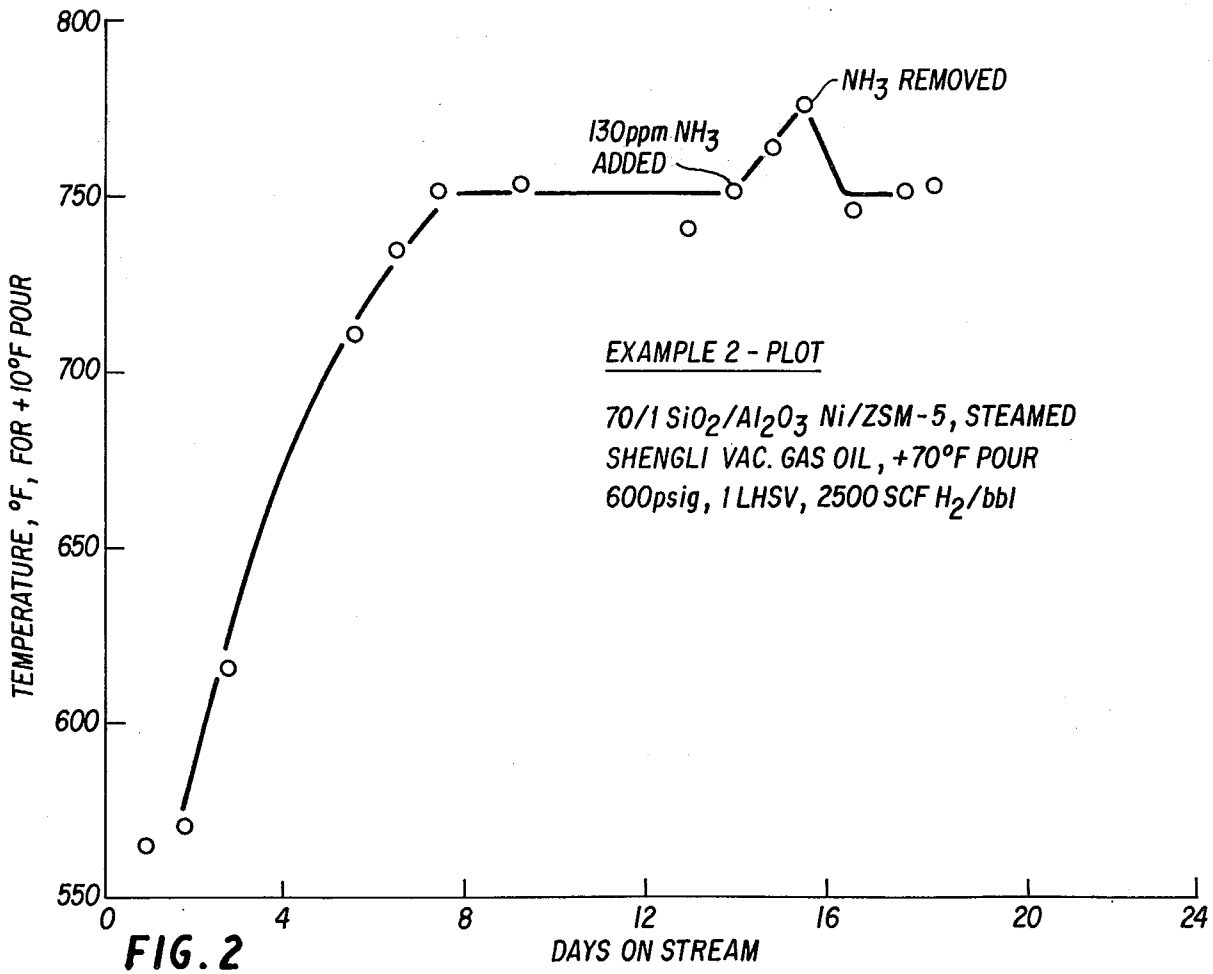
FIG. 2 is a plot of the temperature used in the dewaxing process necessary to obtain a product having a pour point of 0° F. as a function of days the catalyst has been used, for the data of Example 2.

Reaction conditions were 600 psig, 1 LHSV and 2500 standard cubic feet of hydrogen gas per barrel (SCF $H_2$/bbl), temperature adjusted to get +10° F. pour (see Table IV for run data). After about 8 days on stream, the temperature equilibrated at 750° F. (see FIG. 2). At 14 days on stream, 130 ppm $NH_3$ was dissolved in the charge, resulting in a 25° F. activity loss over a 38 hour period.

EXAMPLE 3

1670/1 $SiO_2/Al_2O_3$ ratio Ni/ZSM-5 extrudate was used in this Example. Charge stock was Michigan Furnace Oil having the following properties:

| | |
|---|---|
| Gravity, °API | 38.6 |
| Gravity, Specific | 0.8319 |
| Pour Point, °F. | +25 |
| Distillation, °F. | |
| IBP | 358 |
| 5 percent | 480 |
| 10 percent | 495 |
| 30 percent | 555 |
| 50 percent | 573 |
| 70 percent | 596 |
| 90 percent | 616 |
| 95 percent | 628 |
| Sulfur, weight percent | 0.29 |
| Nitrogen, ppm | 52 |

The Michigan Furnace Oil had the following composition:

| Component | Wt. % |
|---|---|
| Silica Gel Non-Aromatics | 78.55 |
| Silica Gel Aromatics | 21.45 |

TABLE IV

EXAMPLE 2 - RUN DATA

Catalyst: 70/1 $SiO_2/Al_2O_3$ Ni/ZSM-5, 1.0 weight percent Ni, steamed 6 hours at 850° F., 100 percent steam, sulfided Charge: Shengli Vacuum Gas Oil (+70° F. Pour)

Conditions: 1 LHSV, 600 psig, 2500 SCF $H_2$/bbl

| Run No. | 1 | 2 | 3 | 4 | 5 | 6 | 7,8 | 9,10 | 11 | 12 | 13 | 14[1] | 15 | 16 |
|---|---|---|---|---|---|---|---|---|---|---|---|---|---|---|
| $NH_3$ added | ← | ← | ← | NO | → | → | → | → | → | ←130 ppm→ | | ← | NO | → |
| Run time, hours | 22.5 | 22 | 23 | 70 | 22 | 22.5 | 44 | 88.5 | 23.5 | 21 | 17 | 27.5 | 21.5 | 18.5 |
| Accumulative time, days | 0.9 | 1.8 | 2.7 | 5.6 | 6.5 | 7.4 | 9.2 | 12.9 | 13.9 | 14.8 | 15.5 | 16.6 | 17.5 | 18.3 |
| Average catalyst temperature, °F. | 550 | 601 | 600 | 710 | 749 | 749 | 748 | 765 | 767 | 766 | 770 | 766 | 765 | 764 |
| Liquid product pour point, °F. | +40 | −50 | +40 | +10 | −20 | +15 | +20 | −40 | −25 | 0 | +20 | −35 | −20 | −15 |
| Material balance, weight percent | — | — | — | — | 97.3 | — | 102.1 | — | 100.0 | 96.6 | — | — | — | — |
| Yields, weight percent (NLB) | | | | | | | | | | | | | | |
| $C_1 + C_2$ | — | — | — | — | 0.2 | — | 0.1 | — | 0.2 | 0.3 | — | — | — | — |
| $C_3$, Total | — | — | — | — | 8.4 | — | 5.4 | — | 8.7 | 9.6 | — | — | — | — |
| $C_3^=$ (propene) as percentage of total $C_3$ | | | | | 31 | — | 30 | | 38 | 46 | N/A[3] | N/A[3] | N/A[3] | N/A[3] |
| $C_4$, Total | — | — | — | — | 11.7 | — | 10.0 | — | 12.4 | 8.5 | — | — | — | — |
| $C_4^=$ (butenes) as percentage of total $C_4$ | | | | | 44 | — | 52 | | 50 | 50 | N/A[3] | N/A[3] | N/A[3] | N/A[3] |
| $C_5$, Total | — | — | — | — | 7.0 | — | 7.0 | — | 7.7 | 5.2 | — | — | — | — |
| $C_5^=$ (pentenes) as percentage of total $C_5$ | | | | | 57 | — | 64 | | 64 | 72 | N/A[3] | N/A[3] | N/A[3] | N/A[3] |
| $C_6$ - 330° F. | — | — | — | — | 72.8 | — | 77.8 | — | 13.8 | 12.2 | — | — | — | — |
| 330° F.+ | — | — | — | — | | — | | — | 57.5 | 64.5 | — | — | — | — |
| $H_2$ consumption, SCF/bbl | — | — | — | — | 115 | — | 175 | — | 245 | 145 | — | — | — | — |
| 330° F.+ product | | | | | | | | | | | | | | |
| Gravity, °API | — | — | — | — | — | — | — | — | 31.1 | 31.9 | — | — | — | — |
| Gravity, specific | — | — | — | — | — | — | — | — | 0.8702 | 0.8660 | — | — | — | — |
| Pour point, °F. | — | — | — | — | — | — | — | — | −15 | +10 | — | — | — | — |
| Temperature for, 40° F. pour point liquid product[2] | 565 | 570 | 615 | 710 | 734 | 752 | 753 | 740 | 750 | 763 | 775 | 743 | 750 | 751 |

[1]Hydrogen purge after $NH_3$-containing charge stock removed

[2]Correction factor 5° F. in temperature for each 10° F. pour point deviation from +10° F.

[3]Data not available.

-continued

| Component | Wt. % |
|---|---|
| Total Paraffins | 53.58 |
| Total Naphthenes | 24.66 |
| Total Aromatics | 21.80 |
| Silica Gel Non-Aromatics Composition | |
| Paraffins | 68.20 |
| 1 Ring Naphthenes | 15.56 |
| 2 Ring Naphthenes | 9.68 |
| 3 Ring Naphthenes | 4.75 |
| 4 Ring Naphthenes | 1.41 |
| Mono-Aromatics | 0.40 |
| Silica Gel Aromatics Composition | |
| Alkyl Benzenes | 5.24 |
| Naphthene Benzenes | 3.35 |
| Dinaphthene Benzenes | 3.21 |
| Naphthalenes | 5.56 |
| Acenaphthenes | 1.83 |
| Fluorenes | 1.14 |
| Phenathrenes | 0.33 |
| Naphthene Phenathrenes | 0.00 |
| Pyrenes | 0.05 |
| Chrysenes | 0.00 |
| Benzofluoranthenes | 0.00 |
| Perylenes | 0.01 |
| Dibenzanthracenes | 0.00 |
| Benzothiophenes | 0.66 |
| Dibenzothiophenes | 0.07 |
| Naphthobenzothiophenes | 0.00 |

-continued

| Component | Wt. % |
|---|---|
| Unidentified | 0.03 |

Figure 3:
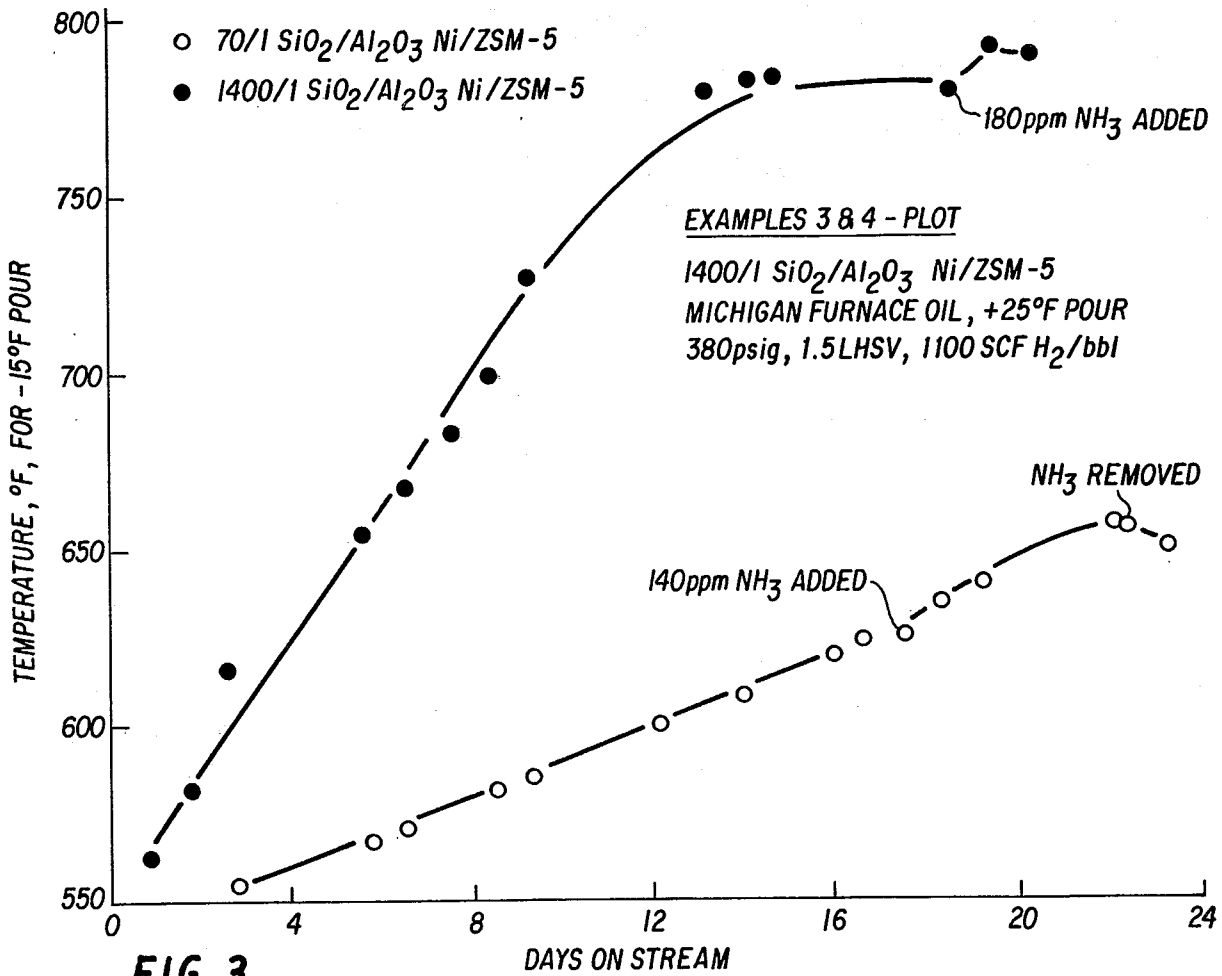
FIG. 3 is a plot of the temperature used in the dewaxing process necessary to obtain a product having a pour point of 0° F. as a function of days the catalyst has been used, for the data of Examples 3 and 4.

Reaction conditions were 380 psig, 1.5 LHSV and 1100 SCF $H_2$/bbl temperature adjusted to get −15° F. pour (see Table V for run data). After about 14 days on stream, the temperature equilibrated at 778° F. (see FIG. 3). At 19 days on stream, 180 ppm $NH_3$ was dissolved in the charge, resulting in only a 7° F. loss in activity over a 45 hour period.

TABLE V

EXAMPLE 3 - RUN DATA

Catalyst 1670/1 $SiO_2/Al_2O_3$ Ni/ZSM-5, 0.83 weight percent Ni, sulfided
Charge Michigan Furnace Oil (+25° F. Pour)
Conditions 1.5 LHSV, 380 psig, 1100 SCF $H_2$/bbl

| Run No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| $NH_3$ added | ← | ← | ← | ← | ← | NO | | → | → | → | → | → | ←180 ppm→ | |
| Run time, hours | 18.5 | 22.5 | 22.5 | 70.5 | 22.5 | 22.5 | 22.5 | 22.5 | 94.5 | 22.5 | 15 | 92.5 | 22.5 | 22.5 |
| Accumulative time, days | 0.8 | 1.7 | 2.6 | 5.6 | 6.5 | 7.5 | 8.4 | 9.3 | 13.3 | 14.2 | 14.8 | 18.7 | 19.6 | 20.5 |
| Average catalyst temperature, °F. | 553 | 568 | 618 | 648 | 657 | 672 | 685 | 715 | 777 | 777 | 777 | 770 | 775 | 775 |
| Liquid product pour point, °F. | +10 | +20 | +10 | −5 | +5 | +5 | +10 | +5 | −15 | −10 | −10 | −5 | +10 | +5 |
| Material balance, weight percent | 99.1 | 102.3 | 98.8 | 97.7 | 99.5 | 97.5 | — | — | 97.8 | — | — | 99.9 | — | 99.4 |
| Yields, weight percent(NLB) | | | | | | | | | | | | | | |
| $C_1 + C_2$ | <0.1 | <0.1 | <0.1 | <0.1 | <0.1 | 0.1 | — | — | 0.2 | — | — | 0.2 | — | 0.1 |
| $C_3$, Total | 1.2 | 0.2 | 1.7 | 1.3 | 2.4 | 2.2 | — | — | 3.5 | — | — | 3.4 | — | 2.8 |
| $C_3^=$ (propene) as percentage of total $C_3$ | 31 | N/A[2] | 26 | 13 | 29 | 26 | N/A[2] | | 28 | — | — | 32 | — | 35 |
| $C_4$, Total | 2.3 | 1.8 | 2.7 | 3.6 | 3.6 | 2.6 | — | — | 7.0 | — | — | 6.5 | — | 5.4 |
| $C_4^=$ (butenes) as percentage of total $C_4$ | 29 | 43 | 37 | 39 | 41 | 40 | N/A[2] | | 48 | — | — | 48 | — | 52 |
| $C_5$, Total | 1.6 | 3.0 | 2.0 | 3.3 | 2.5 | 1.9 | — | — | 5.3 | — | — | 4.8 | — | 2.9 |
| $C_5^=$ (pentenes) as percentage of total $C_5$ | 41 | 55 | 53 | 53 | 57 | 60 | N/A[2] | | 59 | — | — | 63 | — | 65 |
| $C_6$ - 330° F. | 95.0 | 95.1 | 93.8 | 92.0 | 91.7 | 93.4 | — | — | 9.1 | — | — | 85.4 | — | 6.4 |
| 330° F.+ | | | | | | | — | — | 75.2 | — | — | | — | 82.6 |
| $H_2$ consumption, SCF/bbl | 40 | 75 | 115 | 85 | 125 | 120 | — | — | 140 | — | — | 180 | — | 170 |
| 330° F.+ product | | | | | | | | | | | | | | |
| Gravity, °API | — | — | — | — | — | — | — | — | 36.3 | — | — | — | — | 39.2 |
| Gravity, specific | — | — | — | — | — | — | — | — | 0.8433 | — | — | — | — | 0.8348 |
| Pour point, °F. | — | — | — | — | — | — | — | — | −15 | — | — | — | — | +5 |
| Temperature for −15° F. pour point liquid product[1] | 563 | 586 | 631 | 653 | 667 | 682 | 698 | 725 | 777 | 780 | 780 | 775 | 788 | 785 |

[1]Correction factor 5° F. in temperature for each 10° F. pour point deviation from −15° F.
[2]Data not available.

EXAMPLE 4

70/1 $SiO_2/AL_2O_3$ ratio Ni/ZSM-5 extrudate, containing 65 percent ZSM-5, 35 percent $Al_2O_3$ and 1 percent nickel, sulfided in situ, was used in this example. The charge stock and conditions were the same as those used in Example 3, with temperature again adjusted to get −15° F. pour (see Table VI for run date). After about 17 days on stream, the temperature equilibrated at 620° F. (see FIG. 3). At 18 days on stream, 140 ppm $NH_3$ was dissolved in the charge resulting in about 30° F. loss in activity over a 111½ hour period. No further deactivation occurred in the next 5 hours. At that point, the $NH_3$-containing charge was removed, the catalyst purged overnight and then the $NH_3$-free charge introduced. The catalyst regained only 5° F. in 22 hours, indicating an irreversible deactivation of about 25° F.

TABLE VI

EXAMPLE 4 - RUN DATA

Catalyst: 70/1 $SiO_2/AlO_3$ Ni/ZSM-5, 1.0 weight percent Ni, sulfided
Charge: Michigan Furnace Oil (+25° F. Pour)
Conditions: 1.5 LHSV, 380 psig, 1100 SCF $H_2$/bbl

| Run No. | 1 | 2 | 3 | 4 | 5 | 6 | 7 | 8 | 9 | 10 | 11 | 12 | 13 | 14 | 15 | 16 | 17[2] |
|---|---|---|---|---|---|---|---|---|---|---|---|---|---|---|---|---|---|
| $NH_3$ Added | ← | ← | ← | ← | ← | ← | NO | → | → | → | → | → | ← | 140 ppm | | → | No |
| Run Time, Hrs. | 21.5 | 21.5 | 23.5 | 69 | 22 | 46 | 21.5 | 67 | 46.5 | 47 | 16 | 20.5 | 18.5 | 22.5 | 70.5 | 5 | 22 |
| Accumulative Time, Days | 0.9 | 1.8 | 2.8 | 5.7 | 6.6 | 8.5 | 9.4 | 12.2 | 14.1 | 16.1 | 16.7 | 17.6 | 18.4 | 19.3 | 22.2 | 22.4 | 23.3 |
| Average Cat. Temp., °F. | 550 | 527 | 550 | 560 | 565 | 576 | 585 | 598 | 598 | 607 | 610 | 616 | 616 | 617 | 635 | 635 | 636 |
| Liquid Product Pour Point °F. | −50 | +5 | −5 | −5 | −5 | −5 | −10 | −15 | 0 | 0 | −5 | −5 | +15 | +20 | +20 | +15 | +5 |
| Material Bal. Weight percent | — | 97.0 | 95.3 | — | — | — | — | 96.5 | — | — | 96.2 | 98.1 | 99.7 | 100.0 | 100.3 | 99.7 | 98.6 |
| Yields, Weight percent (NLB) | | | | | | | | | | | | | | | | | |
| $C_1 + C_2$ | — | 0.1 | 0.1 | — | — | — | — | 0.1 | — | — | 0.1 | 0.1 | <0.1 | <0.1 | <0.1 | <0.1 | <0.1 |
| $C_3$, Total | — | 2.2 | 3.8 | — | — | — | — | 2.2 | — | — | 1.2 | 1.8 | 0.4 | 0.2 | 0.5 | 1.0 | 1.4 |
| $C_3^{=}$ (propene) as percentage of total $C_3$ | | 8 | 7 | — | — | — | — | N/A[3] | — | — | 42 | 38 | 46 | N/A[3] | 19 | 60 | 33 |
| $C_4$, Total | — | 2.4 | 3.6 | — | — | — | — | 4.9 | — | — | 0.8 | 1.4 | 0.3 | 0.2 | 1.1 | 0.4 | 1.2 |
| $C_4^{=}$ (butenes) as percentage of total $C_4$ | | 12 | 11 | — | — | — | — | 24 | — | — | 22 | 23 | 15 | 50 | 45 | 43 | 31 |
| $C_5$, Total | — | 2.3 | 2.9 | — | — | — | — | 4.1 | — | — | 1.6 | 2.2 | 0.6 | 0.2 | 0.9 | 0.4 | 1.5 |
| $C_5^{=}$ (pentenes) as percentage of total $C_5$ | | 22 | 22 | — | — | — | — | 35 | — | — | 46 | 36 | 65 | — | 72 | 69 | 51 |
| $C_6$ - 330° F. | — | 4.1 | 8.1 | — | — | — | — | 88.9 | — | — | 96.6 | 10.0 | 3.2 | 1.1 | 97.9 | 98.5 | 96.2 |
| 330° F.+ | — | 89.4 | 81.8 | — | — | — | — | | — | — | | 84.8 | 95.8 | 98.6 | | | |
| $H_2$ Consumption, SCF/bbl | — | 200 | 185 | — | — | — | — | 120 | — | — | 180 | 180 | 190 | 175 | 225 | 170 | 145 |
| 330° F. Product | | | | | | | | | | | | | | | | | |
| Gravity, °API | — | 37.6 | 36.3 | — | — | — | — | — | — | — | — | 36.5 | 38.0 | 38.6 | — | — | — |
| Gravity, Specific | — | 0.8368 | 0.8433 | — | — | — | — | — | — | — | — | 0.8423 | 0.8348 | 0.8319 | — | — | — |
| Pour Point °F. | — | +10 | −5 | — | — | — | — | — | — | — | — | 0 | +20 | +25 | — | — | — |
| Temp for −15° F. Pour Point Liquid Product[1] | 532 | 537 | 555 | 565 | 570 | 581 | 588 | 598 | 606 | 615 | 620 | 621 | 631 | 635 | 653 | 650 | 646 |

[1]Correction Factor 5° F. in temperature for each 10° F. pour point deviation from −15° F.
[2]Overnight hydrogen purge after $NH_3$ - containing charge stock removed.
[3]Data not available.

The $NH_3$ effect in the four examples is summarized in Table VII below:

TABLE VI

| Example | 1 | 2 | 3 | 4 |
|---|---|---|---|---|
| Cat., $SiO_2/Al_2O_3$ ratio | 70 | 70 | 1670 | 70 |
| Charge | Arab Light Gas Oil | Shengli Vac Gas Oil | Michigan Furnace Oil | Michigan Furance Oil |
| Equilibrium Temperature, °F. | 580 | 750 | 778 | 620 |
| $NH_3$ Added to Charge, ppm | 63 | 130 | 180 | 140 |
| Hours on Stream with $NH_3$ | 24 | 21 38 | 22.5 45 | 111.5 |
| Activity Loss Due to $NH_3$, °F. | 30 | 13 25 | 10 7 | 25 |

Data of examples 3 and 4 demonstrates that the higher $SiO_2/Al_2O_3$ ratio ZSM-5 has surprisingly superior resistance to $NH_3$ deactivation.

As discussed above, ammonia is present in varying concentrations in refinery hydrogen streams that are piped to distillate dewaxing (DDW) units. Very small amounts of $NH_3$ are also made in the DDW process, depending on the charge stock, and these amounts build up in the hydrogen recycle gas stream unless provisions are made for their removal (acid treat, water wash, etc.). Use of the catalyst herein found to be surprisingly resistant to $NH_3$ deactivation avoids this added expense.

It will be apparent to those skilled in the art that the specific embodiments discussed above can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. In a hydrowaxing process, conducted at temperatures of between about 400° F. and about 825° F., pressures of between about 10 and about 2500 psig, liquid hourly space velocity of between about 0.1 and about 10, and molar ratios of hydrogen to hydrocarbon charge of between about 2 and about 80 and in an environment containing from 1 to 250 ppm of $NH_3$, for the selective cracking of straight-chain hydrocarbons and slightly branched-chain hydrocarbons from a mixture of the same with compounds of different molecular shapes, the improvement which comprises contacting said mixture with a highly siliceous porous crystalline material related to the zeolite ZSM-5 having a $SiO_2/Al_2O_3$ mole ratio of greater than about 200 and having an X-ray diffraction pattern as set forth in Table I.

2. The process of claim 1 wherein said slightly branched hydrocarbons do not possess a quaternary carbon atom.

3. The process of claim 1 wherein said crystalline material has a hydrogenation function.

4. In a process for hydrodewaxing petroleum charge stocks having a boiling point above 350° F., conducted at temperatures of between about 400° F. and about 825° F., pressures of between about 10 and about 2500 psig, liquid hourly space velocity of between about 0.1 and about 10, and molar ratios of hydrogen to hydrocarbon charge of between about 2 and about 80 and in an environment containing from 1 to 250 ppm of $NH_3$, the improvement which comprises contacting said charge stocks with a highly siliceous porous crystalline material, having a $SiO_2/Al_2O_3$ mole ratio greater than about 200:1, related to the zeolite ZSM-5 and having an X-ray diffraction pattern set forth in Table I, so as to selectively crack straight-chain hydrocarbons and branched-chain hydrocarbons free from quaternary carbon atoms in their structure.

5. In a hydrodewaxing process, conducted at temperatures of between about 400° F. and about 825° F., pressures of between about 10 and about 2500 psig, liquid hourly space velocity of between about 0.1 and about 10, and molar ratios of hydrogen to hydrocarbon charge of between about 2 and about 80 and conducted in an environment containing from 1 to 250 ppm of $NH_3$, for the selective cracking of straight-chain hydrocarbons and branched-chain hydrocarbons which are free from quaternary carbon atoms in their structure from a mixture of the same with cyclic compounds, and branched-chain hydrocarbons containing quaternary carbon atoms, the improvement which comprises contacting said mixture with a highly siliceous porous crystalline material, having a $SiO_2/Al_2O_3$ mole ratio greater than about 200, related to the zeolite ZSM-5 and having an X-ray diffraction pattern set forth in Table I.

6. In a hydrodewaxing process, conducted at temperatures of between about 400° F. and about 825° F., pressures of between about 10 and about 2500 psig, liquid hourly space velocity of between about 0.1 and about 10, and molar ratios of hydrogen to hydrocarbon charge of between about 2 and about 80 and in an environment containing from 1 to 250 ppm of $NH_3$, for the selective conversion of straight-chain hydrocarbons and branched-chain hydrocarbons free from quaternary carbon atoms from a mixture of the same with compounds of differing molecular shape, the improvement which comprises contacting the same with a highly siliceous porous crystalline material, having a $SiO_2/Al_2O_3$ mole ratio greater than about 200, related to the zeolite ZSM-5 and under cracking conditions such that the straight-chain hydrocarbons and slightly branched hydrocarbons are able to enter into the pores of said crystalline material and be cracked, said crystalline material having an X-ray diffraction pattern as set forth in Table I.

7. The process of claim 1 wherein said mixture is crude oil.

8. The process of claim 1 wherein said mixture is full range dehydrated shale oil.

9. The process of claim 1 wherein said mixture is a lube oil stock.

10. The process of claims 1, 4, 5 or 6 wherein said highly siliceous porous crystalline material is thermally treated by heating to a temperature in the range of 200° C. to 600° C. for between 1 and 48 hours.

11. The process of claim 2 wherein said highly siliceous porous crystalline material is thermally treated by heating to a temperature in the range of 200° C. to 600° C. for between 1 and 48 hours.

12. The process of claim 3 wherein said highly siliceous porous crystalline material is thermally treated by heating to a temperature in the range of 200° C. to 600° C. for between 1 and 48 hours.

13. The process of claims 1, 4, 5 or 6 wherein said crystalline material has a composition, in the uncalcined form, in terms of mole ratios of oxides as follows:

$$0.9\pm0.2[xR_2O+(1-x)M_{2/n}O]:<0.005Al_2O_3:>1\ SiO_2$$

wherein M is a metal other than a metal of Group IIIA, n is the valence of said metal, R is an alkyl ammonium radical and x is greater than 0 but not greater than 1.

14. The process of claim 10 wherein said highly siliceous porous crystalline material contains less than about 0.5 percent by weight of an alkali metal.

15. In a dewaxing process, conducted at a temperature of between about 550° F. and about 1100° F. and at liquid hourly space velocity of between about 0.5 and about 50 in an environment containing from 1 to 250 ppm of $NH_3$, for the selective cracking of straight-chain hydrocarbons and slightly branched-chain hydrocarbons from a mixture of the same with compounds of different molecular shapes, the improvement which comprises contacting said mixture with a highly siliceous porous crystalline material related to the zeolite ZSM-5 having a $SiO_2/Al_2O_3$ mole of greater than about 200 and having an X-ray diffraction pattern as set forth in Table I.

16. The process of claim 15 wherein said crystalline material has a composition, in the uncalcined form, in terms of mole ratios of oxides as follows:

$$0.9\pm0.2[xR_2O+(1-x)M_{2/n}O]:<0.005Al_2O_3:>1\ SiO_2$$

wherein M is a metal other than a metal of Group IIIA, n is the valence of said metal, R is an alkyl ammonium radical and x is greater than 0 but not greater than 1.

17. The process of claim 15 wherein said highly siliceous porous crystalline material contains less than about 0.5 percent by weight of an alkali metal.

18. The process of claim 14 wherein the alkali metal is sodium.

19. The process of claim 17 wherein the alkali metal is sodium.

* * * * *

UNITED STATES PATENT AND TRADEMARK OFFICE

CERTIFICATE OF CORRECTION

PATENT NO. : 4,441,991

DATED : April 10, 1984

INVENTOR(S) : F.G. DWYER and W.E. GARWOOD

It is certified that error appears in the above-identified patent and that said Letters Patent is hereby corrected as shown below:

Column 19, Line 7 under Column 11: "-5" should be --+5--.

Claim 1, Line 1: "hydrowaxing" should be --hydrodewaxing--.

Signed and Sealed this

*Sixteenth* Day of *October 1984*

[SEAL]

*Attest:*

GERALD J. MOSSINGHOFF

*Attesting Officer*

*Commissioner of Patents and Trademarks*